United States Patent [19]

Sakamaki et al.

[11] Patent Number: 4,649,612

[45] Date of Patent: Mar. 17, 1987

[54] METHOD OF MANUFACTURING A ROTOR FOR ROTARY FLUID PUMPS

[75] Inventors: Hiroshi Sakamaki, Utsunomiya; Susumu Sugishita, Hanyu; Yukio Horikoshi, Kazo; Hiroshi Okamura, Ashikaga; Kenji Shimizu, Sano, all of Japan

[73] Assignees: Nippon Piston Ring Co., Ltd., Tokyo; Kabushiki Kaisha Tokiwaseisakusho, Tochigi, both of Japan

[21] Appl. No.: 810,354

[22] Filed: Dec. 18, 1985

[30] Foreign Application Priority Data

Dec. 26, 1984 [JP] Japan ..... 59-273429

[51] Int. Cl.[4] ..... B23P 15/00

[52] U.S. Cl. ..... 29/156.4 R; 29/428; 29/DIG. 26; 418/259

[58] Field of Search ..... 29/156.4 R, 428, 557, 29/558, DIG. 26; 418/152, 83, 259, 179

[56] References Cited

U.S. PATENT DOCUMENTS 2,353,965 7/1944 Meador ..... 418/83
2,487,449 11/1949 Knudson ..... 418/152
2,487,685 11/1949 Young ..... 418/83
4,396,365 8/1983 Hayashi ..... 29/156.4 R X
4,514,157 4/1985 Nakamura et al. ..... 418/259
4,526,524 7/1985 Kondo et al. ..... 418/259 X
4,551,896 11/1985 Sakamaki et al. ..... 29/156.4 R

FOREIGN PATENT DOCUMENTS 278382 12/1927 United Kingdom ..... 418/179

*Primary Examiner*—Howard N. Goldberg
*Assistant Examiner*—Ronald S. Wallace
*Attorney, Agent, or Firm*—Birch, Stewart, Kolasch & Birch

[57] ABSTRACT

A method of manufacturing a rotor for rotary fluid pumps comprising the steps of assembling a hollow cylindrical body and both side plates to a hollow rotor body, providing the hollow rotor body with a plurality of sockets each receiving a separately fabricated U-shaped vane-groove forming member, and inserting the U-shaped vane-groove forming members into the respective sockets to fix the same to the rotor body by brazing. The U-shaped vane-groove forming member is made from a suitable material as a vane groove itself and sufficiently finished independently from the rotor body.

12 Claims, 15 Drawing Figures

METHOD OF MANUFACTURING A ROTOR FOR ROTARY FLUID PUMPS

BACKGROUND AND SUMMARY OF THE INVENTION

The present invention relates to a method of manufacturing a rotor for rotary fluid pumps, and more particularly to a method of making a hollow rotor provided with vane grooves to allow the smooth slide of vanes.

Recently, the rotary fluid pump for use in vehicles has been desired to be less in weight for saving energy. The pump can not reduce its weight without substituting the known solid rotor for a hollow rotor. The inventors of this application have proposed an easily producible rotor which is composed of a hollow rotor body, both side plates welded to the both sides of the body and either or both rotary shafts fixed to the side plates. The rotor has been disclosed under JP A No. 59-155592. However, the rotor has a problem that it is not always easy to finish the vane groove to the extent that the vane smoothly slides in the vane groove. The reason for this is that the vane groove is neither always made from a material suitable as a vane groove nor easy to be sufficiently finished because of being integrally made with the rotor body.

The present invention is intended to resolve the problem described above and provide a method to easily produce a rotor that is light in weight and provided with vane grooves sufficiently finished to allow the smooth slide of vanes.

In accordance with the present invention, a U-shaped vane-groove forming member is fabricated separately from a rotor body. The vane-groove forming member can be made from a suitable material and finished so as to allow the smooth slide of a vane. For example, a steel plate is easily U-shaped by press-working and finished by simple finishing steps to improve the sliding performance of a vane.

The hollow cylindrical body are formed with axially full-length slits by machining, while the both side plates are provided with radial slits. The axially full-length slits and the radial slits form a plurality of sockets each being adapted to receive a separately fabricated vane-groove forming member when the cylindrical body and the both side plates are assembled to a rotor body. The vane groove forming member is inserted into the socket and then joined with the rotor body by brazing. The slits may be provided after or before the cylindrical body and the both side plates are assembled. When the slit is formed after the assembling, the rotor body is made of a hollow cylindrical material such as a metal pipe and the like. When the slits are previously provided, the rotor body is made of a plurality of arcuate plates that is produced from the same hollow cylindrical material as when the slits are formed after the assembling.

The side plate and the rotary shaft can be fabricated separately from or integrally with each other. For example, the both are joined with each other by welding when separately fabricated. Otherwise, the both are molded as one body by casting or forging. The both side plates can be fabricated separately from or integrally with each other with the intervention of the rotary shaft.

The axially full-length slits in the cylindrical body as well as the radial slits in the both side plates are simple in shape and easy to be shaped by machining. The U-shaped vane-groove forming member is easily inserted into a socket defined by the slits both in the rotor body and the both side plates. The vane-groove forming member, after inserted in the slit, is fixed to the cylindrical body and the both side plates by brazing. It is easy to set a brazing material such as copper solder and the like in the slits in the side plate. For the purpose of easily setting the brazing material between the vane-groove forming member and the rotor body, the vane-groove forming member is arranged to have its upper edges slightly projected from the outer surface of the rotor body, the brazing material being disposed between the peripheral surface of the rotor body and the upper edges projected therefrom.

The advantages offered by the present invention are mainly that the vane-groove forming member is fabricated independently from the rotor body and made from a material suitable as a vane groove as well as by a method that is relatively simple and efficient as compared with the known method in which the vane groove is integrally formed in the rotor body, and that the vane groove is accurate and superior in sliding characteristics. The rotor body can be simple in shape and easy to be made because of being separated from the vane grooves. The rotor body is easy to join the side plates because of being simple in shape. The vane-groove forming member is easily manufactured by machining because of having a uniform U-shaped section. The separately fabricated vane-groove forming member is accurately fixed to the rotor body by a simple brazing method in which the vane-groove forming member is inserted in the slit of the rotor body in which brazing solders are previously disposed and then put in a furnace together with the rotor body. All in all, the present invention provides a simple method of manufacturing a hollow rotor superior in a vane-sliding performance.

BRIEF DESCRIPTION OF DRAWING

One way of carrying out the invention is described in detail below with reference to drawings which illustrate some preferred embodiments, in which.

DETAILED DESCRIPTION

Figure 1:
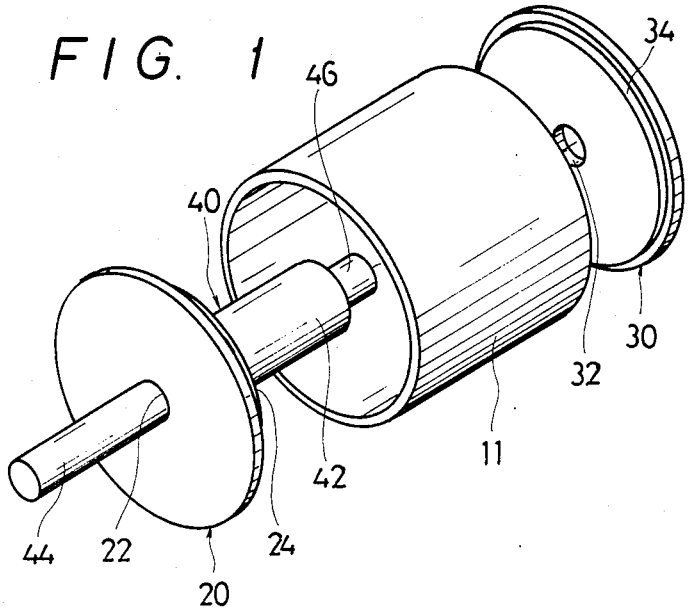
FIG. 1 is a perspective view of members to be assembled to a rotor body in accordance with the inventive method.

As seen in FIG. 1, a rotor is constructed from a hollow cylindrical body 11 in the form of a cut steel pipe and both side plates 20, 30 in the form of a steel disc which are respectively formed with central bores 22, 32 and annular sheets 24, 34. The one side plate 20 has the central bore 22 fitted on and welded to a rotary shaft 40, which is solid and provided with a thicker middle portion 42 between the opposite end portions 44, 46 the diameter of which is similar to the inner diameter of the central bores 22, 32 in the both side plates 20, 30. The body 11 has its both sides fitted on the annular sheets 24, 34 in the both side plates 20, 30 and welded thereto. The rotary shaft 40 has one end portion 46 inserted in and welded to the central bore 32 in the other side plate 20. Thus, the above-mentioned members are assembled to the rotor body 12 of FIG. 2.

Figure 2:
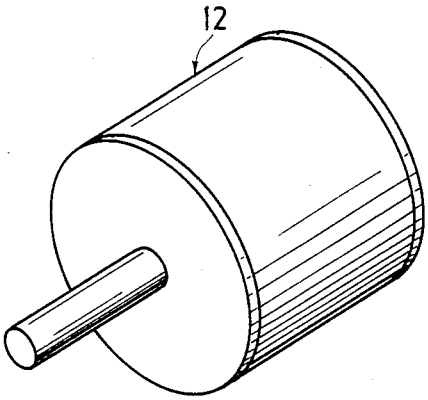
FIG. 2 is a perspective view of a rotor body constructed from the members of FIG. 1.
Figure 3:
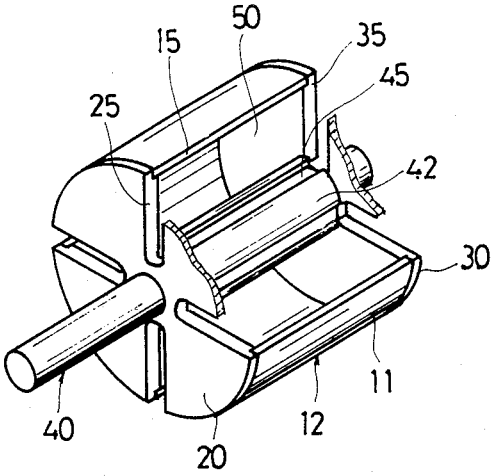
FIG. 3 is a perspective, partly cutaway view of the rotor body provided with sockets defined by slits to receive vane-groove forming members.

The rotor body 12 of FIG. 2 is shaped by machining to the rotor body 12 of FIG. 3 which is formed with four sockets 50 each being defined by radial slits 25, 35 in the both side plates 20, 30, axially full-length slits 15 in the cylindrical body 11, and a shallow groove 45 in the thicker portion 42 of the rotary shaft 40.

Figure 4:
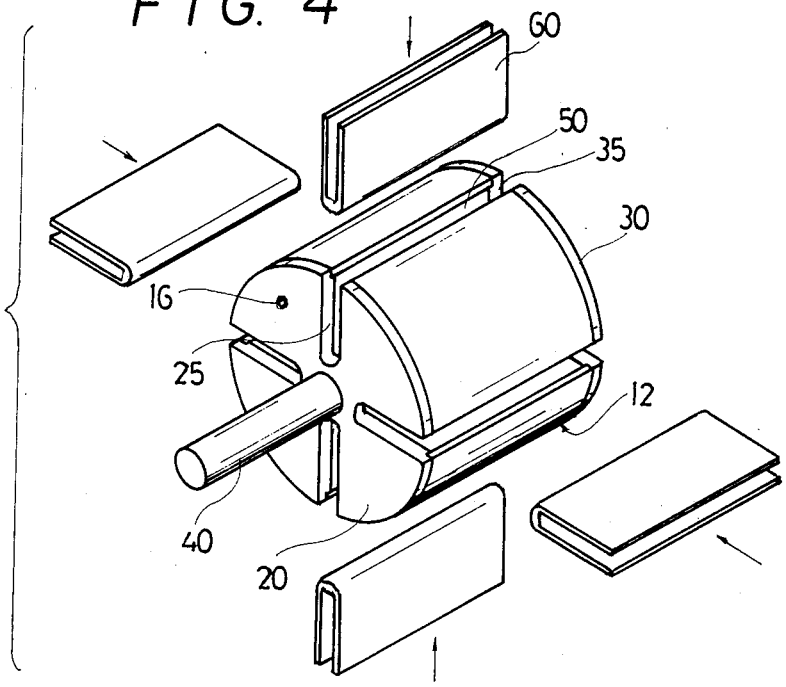
FIG. 4 is a perspective view of the rotor body and vane-groove forming members to be inserted into the sockets in the rotor body.
Figure 5:
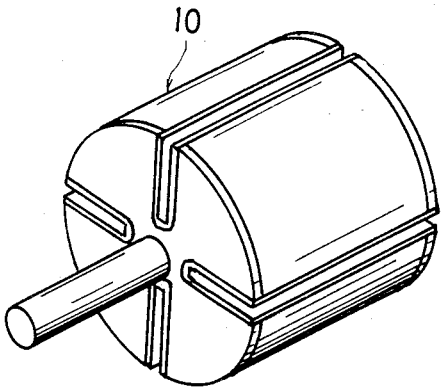
FIG. 5 is a perspective view of a complete rotor.

As shown by the arrows of FIG. 4, separately fabricated U-shaped vane-groove forming members 60 are inserted into the respective sockets 50. Non-illustrated copper plates as a brazing solder are previously placed in the radial slits 25, 35 of the both side plates 20, 30 and in the shallow groove of the rotary shaft 40. The vane-groove forming member 60 is made of a steel plate by press-working, having a uniform U-shaped cross-section. When the U-shaped member 60 is fitted in the rotor body, it is shaped to have its upper edges slightly projected from the outer surface of the rotor body 12. The brazing solder is set along the upper projected edges of the member 60. After the vane-groove forming member is fitted in the socket, the rotor body is put in a brazing furnace to produce a complete rotor 10 of FIG. 5. Prior to being put in the furnace, the rotor body is provided with a vent 16 extending from the hollow inside to the atmosphere, as seen in FIG. 4. Otherwise, brazing would be prevented by the thermal expansion of inside air or gas produced by the solder flux burning. However, the vent is preferably plugged after brazing. Thus brazed rotor needs no more than simple finishing works to be provided with vane grooves in which the respective vanes smoothly slide.

Figure 6:
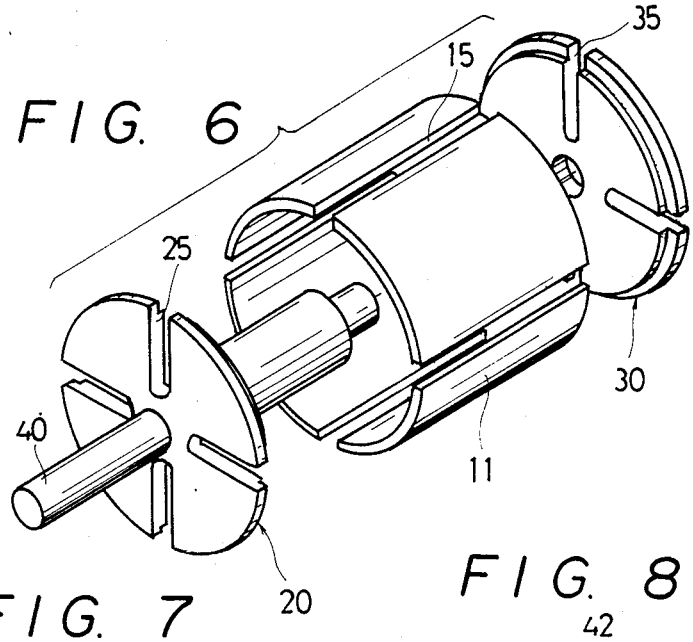
FIG. 6 is a view, similar to FIG. 1, of another embodiment.

As seen in FIG. 6, the slits 15, 25, 35 can previously be provided in the cylindrical body 11 and the both side plates 20, 30. The full-length slits 15 are produced by a process of cutting a steel pipe into four similar arcuate parts of a split cylinder. The radial slits 25, 35 are similar to those in FIG. 3 except being previously provided. Accordingly, the same rotor as in FIG. 3 is obtained when the arcuate parts and the both side plates are assembled. The shallow groove in the thicker portion of the rotary shaft can be provided before the assembling. The manufacturing step after the assembling is the same as in FIG. 4.

Figure 7:
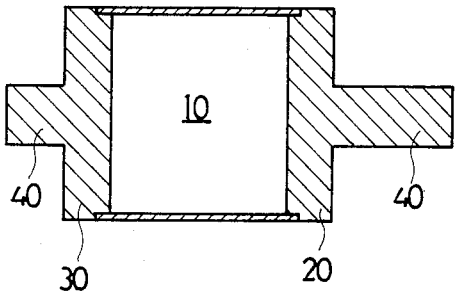
FIGS. 7 to 9 are sectional views of different embodiments.

There are various embodiments with respect to the rotor body and the both side plates, inclusive of the rotary shaft. The light load type can have its right and left rotary shafts 40, 40 separated from each other and fixed to the respective side plates 20, 30, thereby no rotary shaft passing through the inside of the hollow rotor 10, as seen in FIG. 7.

Figure 8:
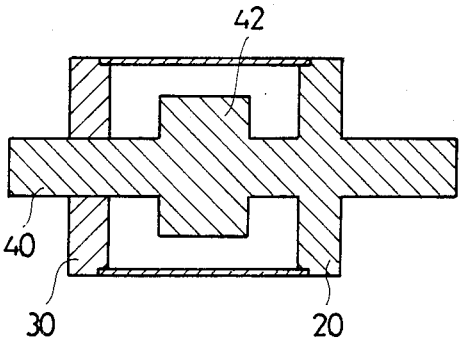

As seen in FIG. 8, one side plate 20 is integrally formed with a rotary shaft 40 to which the other side plate 30 is fixed by welding. The rotary shaft 40 has a centrally thicker portion 42 to reinforce the vane-groove forming member which is brazed in the thicker portion.

Figure 9:
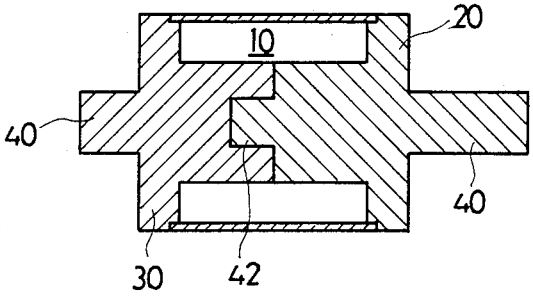

As seen in FIG. 9, the both side plates 20, 30 are integrally formed with the respective rotary shafts 40, 40 which are joined with each other inside the rotor 10. The rotary shafts 40, 40 have a common thicker portion 42 to reinforce the the vane-groove forming member inside the rotor 10.

Figure 10:
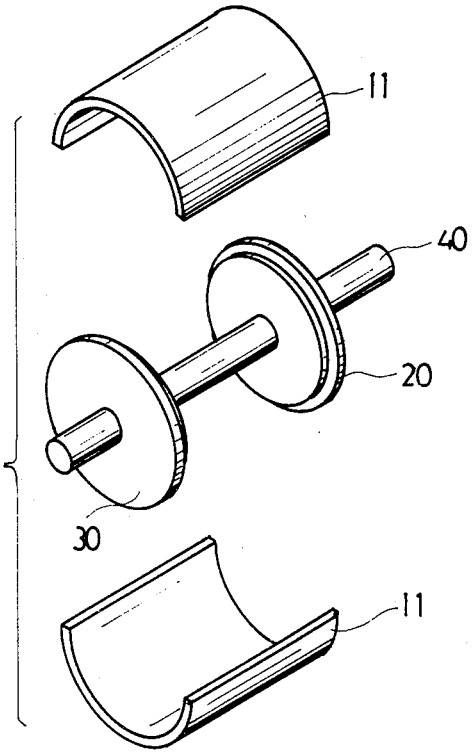
FIG. 10 is a view, similar to FIG. 1, of still another embodiment.

As seen in FIG. 10, the both side plates 20, 30 and the rotary shaft 40, previously fabricated as one piece, are covered by and welded to a pair of semi-cylindrical bodies 11, 11.

Figure 11:
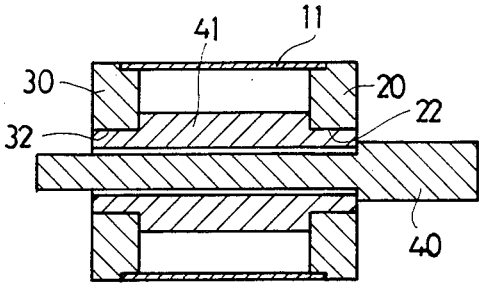
FIGS. 11 to 15 are sectional views of further different embodiments.
Figure 12:
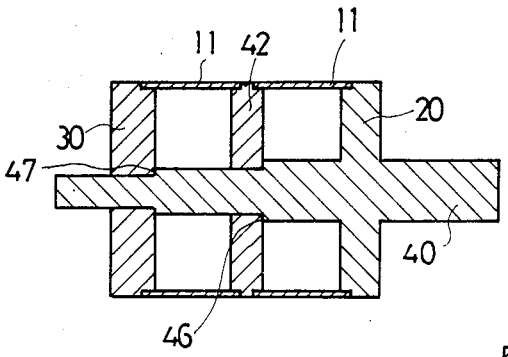

As seen in FIG. 11, a hollow shaft 41 is fitted in the central bores 22, 32 of the both side plates 20, 30 which are previously fixed to the cylindrical body 11. Then, the cylindrical body 11 is easily provided with slits for insertion of the vane-groove forming members by machining because of having no oppositely projecting shaft. The rotary shaft 40 is inserted in the rotor body after the slits have been provided.

The rotor body consists of two cylindrical bodies 11, 11 and a central reinforce disk 42 as seen in FIGS. 12 to 15. The rotor of FIG. 12 has a rotary shaft 40 integrally formed with one side plate 20 and shoulders 46, 47. The other side plate 30 and reinforce disk 42 are fitted on the respective shoulders 46, 47 of the rotary shaft. The two cylindrical bodies 11, 11 are fixed between either of the both side plates 20, 30 and the reinforce disk 42.

Figure 14:
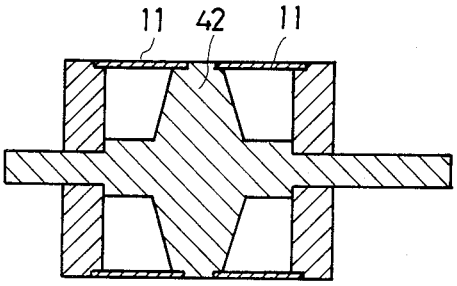
Figure 13:
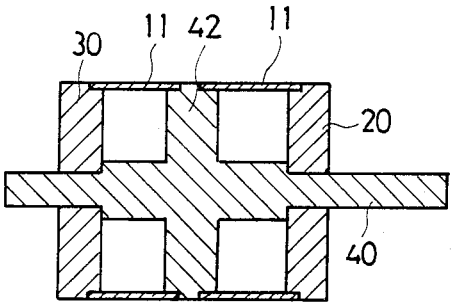

The rotor of FIG. 13 has a rotary shaft 40 integrally formed with the central reinforce disk 42. Two cylindrical bodies 11, 11 are oppositely fitted on the reinforce disk 42 prior to the both side plates 20, 30 are fitted on the rotary shaft 40. The two cylindrical bodies 11, 11 are welded both to the reinforce disk 42 and the side plates 20, 30. The reinforce disk 42 is desirably shaped to have a thicker central portion for the purpose of improving a reinforce effect, as seen in FIG. 14.

Figure 15:
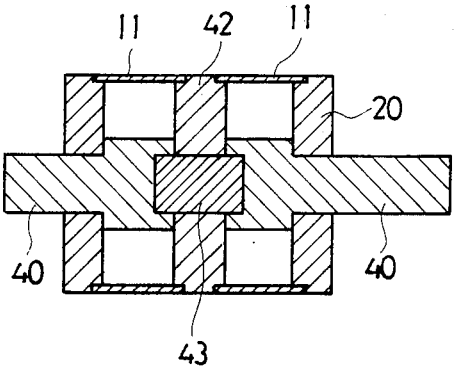

The rotor of FIG. 15 has a reinforce disk 42 separately fabricated from the both rotary shaft 40, 40 and a joint 43 to connect the both rotary shafts 40, 40 and the reinforce disk 42. The both side plates 20, 30 are fitted on the respective rotary shafts 40, 40 to fix the two cylindrical bodies 11, 11.

What is claimed is:

1. A method of manufacturing a rotor for rotary fluid pumps comprising the steps of providing a plurality of slits in each of a hollow cylindrical body and both side plates, assembling said hollow cylindrical body and said both side plates to a rotor body, and inserting separately fabricated U-shaped vane-groove forming members in the respective sockets defined by said slits to fix the same to said rotor body.

2. The method of claim 1, wherein said rotor body has a rotary shaft passing through said side plates, said rotary shaft having a reinforce portion in the middle part thereof.

3. The method of claim 2, wherein said side plates and said rotary shaft are shaped as one body.

4. The method of claim 2, wherein said rotary shaft is separately fabricated and then fixed to said side plates.

5. The method of claim 1, said slits are shaped after said hollow cylindrical body and said both side plates are assembled to said rotor body.

6. The method of claim 5, wherein said rotor body is fabricated from a hollow cylinder.

7. The method of claim 1, wherein said slits are shaped before said hollow cylindrical body and said both side plates are assembled to said rotor body.

8. The method of claim 7, wherein said rotor body is fabricated from a plurality of arcuate plates forming a split cylinder.

9. The method of claims 1, wherein said U-shaped vane-groove forming member is fixed to said hollow cylindrical body and said both plates by brazing.

10. The method of claim 9, wherein said U-shaped vane-groove forming member is inserted into said socket in which a brazing material is previously disposed.

11. The method of claim 10, wherein said U-shaped vane-groove forming member has the upper edges thereof slightly projected from the outer peripheral surface of said rotor body and joined therewith through the intermediary of a brazing material.

12. The method of claim 1, wherein said rotor body is formed with a vent extending from the inside of said rotor body to the atmosphere before said U-shaped vane-groove forming members are brazed to said rotor body.

* * * * *